US005727969A

United States Patent [19]

Yamanashi

[11] Patent Number: 5,727,969

[45] Date of Patent: Mar. 17, 1998

[54] LOW-INSERTION-FORCE CONNECTOR ASSEMBLY

[75] Inventor: Makoto Yamanashi, Shizuoka, Japan

[73] Assignee: Yazaki Corporation, Tokyo, Japan

[21] Appl. No.: 649,235

[22] Filed: May 17, 1996

[30] Foreign Application Priority Data

May 19, 1995 [JP] Japan ..... 7-121347

[51] Int. Cl.[6] ..... H01R 13/40

[52] U.S. Cl. ..... 439/594; 439/924.2

[58] Field of Search ..... 439/594, 701, 439/924.2, 717

[56] References Cited

U.S. PATENT DOCUMENTS

| | | | |
|---|---|---|---|
| 4,973,859 | 11/1990 | Shodoi | 439/924.2 |
| 5,113,311 | 5/1992 | Kamp et al. | 439/924.2 |
| 5,472,357 | 12/1995 | Yamanashi | 439/701 |

FOREIGN PATENT DOCUMENTS

| | | |
|---|---|---|
| 4-33666 | 8/1992 | Japan . |
| 5-234634 | 9/1993 | Japan . |
| 6-111882 | 4/1994 | Japan . |
| 6-215830 | 8/1994 | Japan . |

*Primary Examiner*—Neil Abrams
*Assistant Examiner*—Barry M.L. Standig
*Attorney, Agent, or Firm*—Armstrong, Westerman, Hattori, McLeland & Naughton

[57] ABSTRACT

A first connector (6) has a plurality of connecting bodies (2, 3, 4) slidable in the connector-engaging direction and one or more joinder members (5) for sequentially joining the plurality of connecting bodies. Flexible extended arms (21) are provided in one end portion of the joinder member (5) and have abutting projections (24) and tapered portions. A mating projection (15) provided in the second connector (9) slidably mates with the tapered portion to deflect the flexible extended arm (21) so that the engagement between the abutting projections (24) and the abutted projections (32) provided in the connecting body (2) can be released.

4 Claims, 4 Drawing Sheets

3
17
35
32
39
40
41

LOW-INSERTION-FORCE CONNECTOR ASSEMBLY

BACKGROUND OF THE INVENTION

1. Field of the Invention

This invention relates to a connector assembly with a reduced insertion force, in which a plurality of connecting bodies joined to each other by way of a joinder member are sequentially stepwise coupled to an opposing connector.

2. Description of the Prior Art

FIG. 5 shows a conventional connector assembly with a reduced insertion force disclosed in Japan patent application laid-open No. H. 6-111882.

This reduced insertion force connector assembly 45 includes a male connector 48 having two separated connecting bodies 46, 47 and a female connector 49 receiving the connecting bodies 46, 47 with two steps. The first connecting body 46 is slidable in the coupling direction within an outer housing 50, and the second connecting body 47 is formed integrally with the outer housing 50. Each of the connecting bodies 46, 47 accommodates female terminals (not shown) and the female connector 49 accommodates projecting male terminals (not shown).

The first connecting body 46 has lock hooks 51 that abut against a fore end of the outer housing 50 so as to hold the connecting body 46 extending forward. Meanwhile, in the female connector 49, there are formed a lock-releasing pieces 52 corresponding to the lock hooks 51.

In coupling operation of the male connector 48 and the female connector 49, first, the first connecting body 46 engages with each female connector 49, so that the locks releasing piece 52 presses the associated lock hook 51 to push it back.

Next, the second connecting body 47 engages with the female connector 49. Thus, the male connector 48 engages with the female connector 49 by the two steps, which can reduce the coupling force (insertion force).

However, the above-mentioned conventional reduced insertion force connector assembly can have, at most, two connecting bodies in one connector. Therefore, where a great number of connecting terminals are positioned in one connector assembly, the coupling operation cannot be accomplished easily by hand due to an increased insertion force, which has brought about a drawback that the number of terminals in one connector assembly is limited by it. Further, there has been another drawback in that it is difficult to know the incomplete engagement, when the first connecting body has incompletely engaged.

SUMMARY OF THE INVENTION

In view of the above-mentioned drawbacks, the object of this invention is to provide a low-insertion-force connector assembly, in which the coupling operation can be accomplished easily by hand, even where a great number of connecting terminals are positioned in one connector assembly, and further, the incomplete engagement of connecting bodies is eliminated.

For achieving the object, a low-insertion-force connector according to the present invention includes;

- a first connector having a plurality of connecting bodies slidable in the connector engaging direction and one or more joinder members for sequentially joining the plurality of connecting bodies,
- a second connector receiving the first connector,

- a guiding portion provided in a former connecting body of two adjacent ones of the connecting bodies, the joinder member being slidable along the guiding portion in the connector-engagement direction,
- a flexible extended arm provided in one end portion of the joinder member and having an abutting projection and a tapered portion,
- a joinder portion provided in another end portion of the joinder member and joining the latter connecting body of the two adjacent ones of the connecting bodies,
- a provisional locking portion provided in the flexible extended arm and provisionally locking the joinder member to the guiding portion,
- an abutted projection provided in the former connecting body and abutting against the abutting projection,
- a mating projection provided in the second connector and slidably mating with the tapered portion to deflect the flexible extended arm so that the engagement between the abutting projection and the abutted projection can be released,
- a flexible lock arm provided in the former connecting body and locking the former connecting body to the second connector when the former connecting body has completely engaged with the second connector, the flexible lock arm having a retaining projection, and
- a pushing projection provided in the extended arm and being able to abut against the retaining projection only when the former connecting body has incompletely engaged with the second connector so that the lock arm has been deflecting.

Further, the joinder member may be formed integrally with another connecting body. Moreover, the joinder member may have a deflection-restricting portion that can advance into a deflection-permitting space for the lock arm.

Operation of the present invention will be discussed in the following.

The provisional locking portion in one end portion of the joinder member is provisionally engaged with the first connecting body. Then, the joinder member is pushed in the connector-coupling direction so that the provisional locking portion is released and the abutting projection makes the first connecting body engage with the second connector. Simultaneously with the engagement, the gently sloping projection makes contact with the abutted projection so that the extended arm deflects outwardly to release the abutment. Thereby, the joinder member can advance and the second connecting body joined with the other end of the joinder member in a body advances to be engaged with the second connector. The third connecting body joined to the second connecting body by way of another joinder member is engaged with the second connector in the same way as the second connecting body. That is, a plurality of connecting bodies can be sequentially stepwise coupled to the opposing connector with a reduced insertion force. When the first connecting body has been incompletely engaged, the lock arm of the first connecting body has been deflecting so that the abutting projection has been abutting against the retaining projection of the lock arm. Therefore, the first connecting body can be completely engaged by pushing the second connecting body joined with the first connecting body in a body. Simultaneously with the complete engagement of the connecting bodies, the deflection-restricting portion prevents the lock arm from deflecting to achieve secure locking of the first connecting body.

DETAILED DESCRIPTION OF PREFERRED EMBODIMENTS

Figure 1:
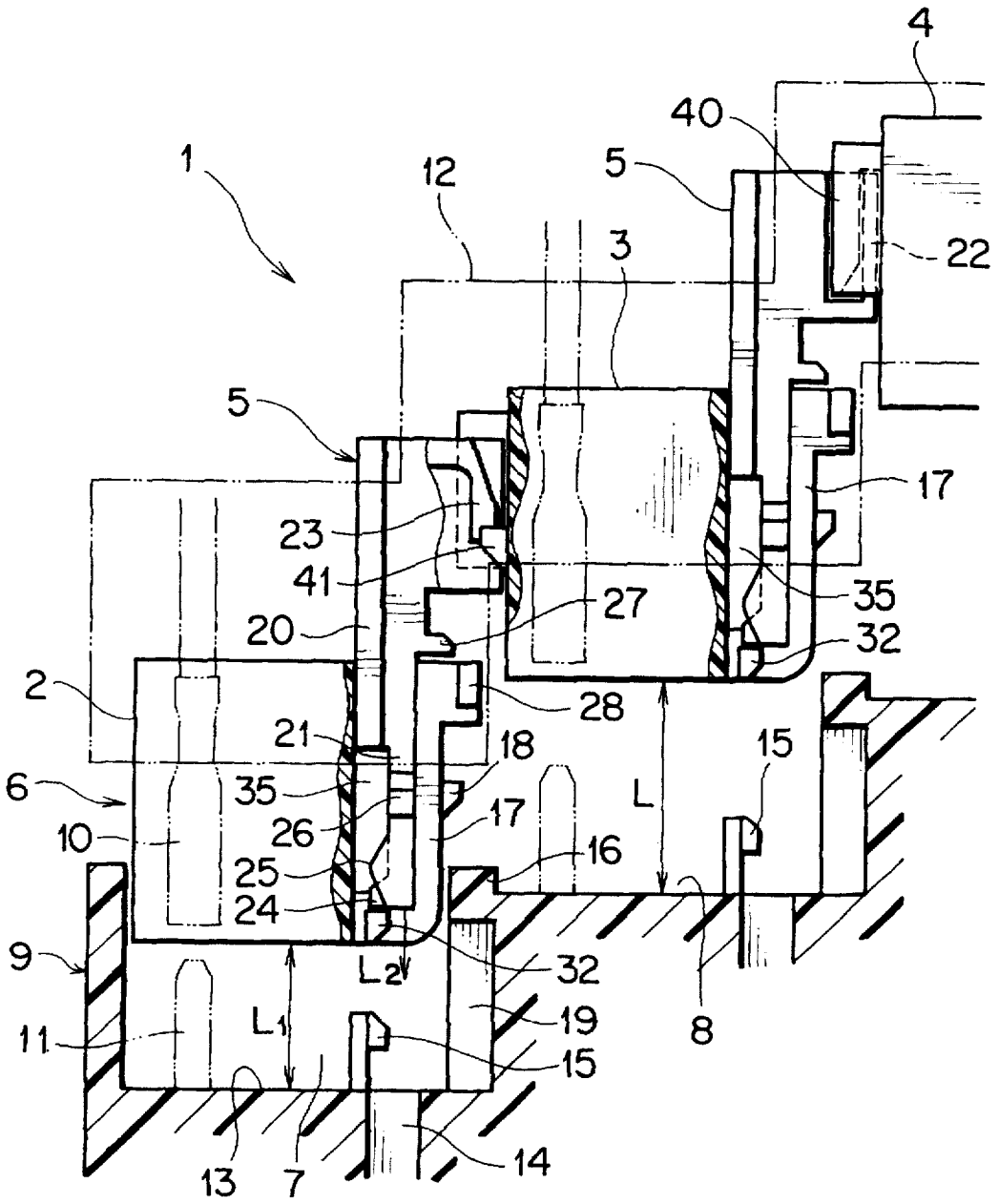
FIG. 1 is a side sectional view showing a an embodiment of an low-insertion-force connector assembly according to the present invention.

FIG. 1 shows an embodiment of a low-insertion-force connector assembly according to this invention. The low-insertion-force connector assembly 1 includes a male connector 6 having a plurality of connecting bodies 2, 3, 4, joinder members 5 joining each of the connecting bodies 2, 3, 4 to each adjacent one and a female connector 9 having engagement portions 7, 8,—(engagement chambers) corresponding to each of the connecting bodies 2, 3, 4. Each of the connecting bodies 2, 3, 4 accommodates a plurality of female terminals 10 and each of the engagement portions 7, 8,—accommodates a plurality of projecting male terminals 11.

In FIG. 1, a rear part of the joinder member 5 is fixed to the connecting body 3, while a fore part of the joinder member 5 can be abutted against, and inserted into, the first connecting body 2. The second connecting body 3 is joined to the third connector 4 by way of the associated joinder member 5 and the third connecting body 4 is joined to the fourth connecting body (not shown) in the same way. Each of the connecting bodies 2, 3, 4 is stepwise joined by way of the joinder members 5, for example, so as to slidably engage an outer housing 12 having step-shaped receiving chambers. The engagement portions 7, 8, - - - in the female connector 9 cooperative with respective of the connecting bodies 2, 3, 4 are formed in the shape of a step. The step-shaped engagement construction of the connecting bodies 2, 3, 4 is similar, for example, to a connector engagement construction of a conventional electrical junction box.

In each bottom wall 13 of the respective engagement portions 7, 8, - - - , an insertion hole 14 is formed for cooperating with a joinder members 5, and also, adjacent to an opening of each insertion hole 14, a pushing projection 15 for releasing the abutment between a fore end of the joinder members 5 and the respective connecting bodies 2, 3, 4 is formed. Further, in a side wall 16 of each of the engagement portions 7, 8, - - - , there is formed an engagement channel 19 corresponding to a locking projection 18 on a flexible lock arm 17 provided in each connecting body 2, 3, 4.

Figure 2A:
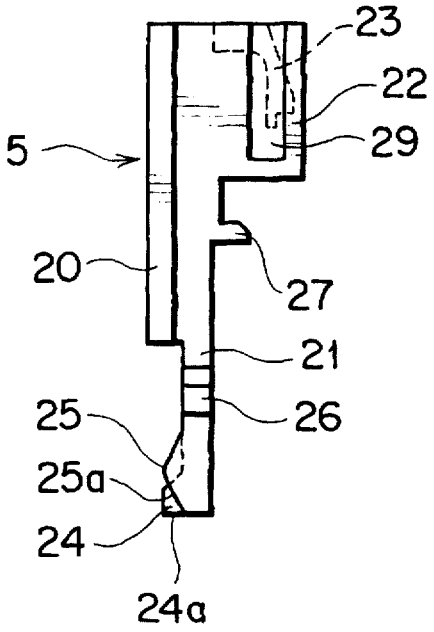
FIG. 2A is a side view of a joinder member in the embodiment.
Figure 2B:
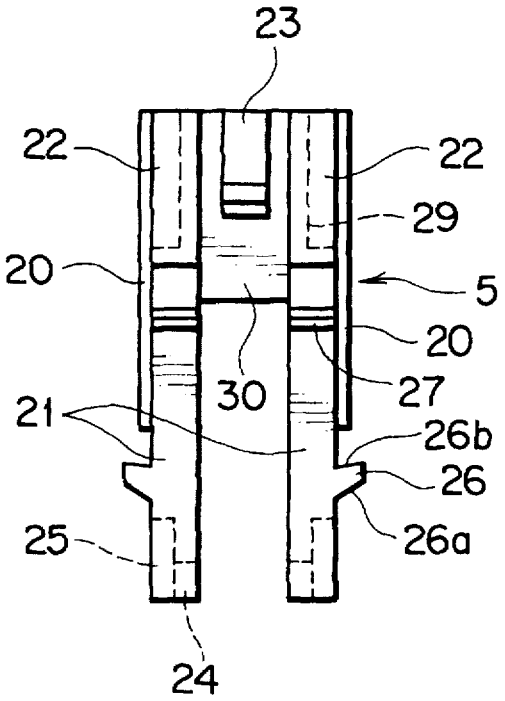
FIG. 2B is the front view of the same.

The joinder member 5, as shown in FIGS. 2A and 2B, has a couple of sliding portions 20 corresponding to each of the connecting bodies 2, 3, 4, couple of flexible extended arms 21 integrally formed on the sliding portion 20, positioned a slightly more inside, as compared with the sliding portion 20, and extending foreword thereof, a couple of joinder guides 22 and a flexible lock hook 23 formed in the rear part of the sliding portion.

In a fore end of the extended arm 21, there are formed an abutting projection 24 and a comparatively gently sloping projection 25 in parallel with each other. The abutting projection 24 has a horizontal abutting surface 24*a* and the gently sloping projection 25 has a tapered mating surface 25*a*. Backward from the gently sloping projection 25, on an outer side of the extended arm 21, there are formed provisional lock hooks 26 cooperative with the connecting bodies 2, 3, 4. Each provisional lock hook 26 tapers backwardly in a hook-shape to have a fore, tapered sliding surface 26*a* and a rear, tapered locking surface 26*b*. The extended arm 21 is deflectable in the opposite directions of the provisional lock hooks 26 and also in the opposite direction to the abutting projections 24.

In the rear portion of the extended arm 21, a pushing projection 27 is formed so as to extend from the arm (in the direction opposite to the projecting direction of the abutting projection 24). The pushing projection 27 can abut against an abutting projection 28 provided on the lock arm 17 of each connecting body 2, 3, 4 (FIG. 1) and can be used to determine a partial engagement state of the connecting body. The pushing projection 27 extends short of the location of the abutting projection 28 in the lock arm 17 when the arm is free (FIG. 1). Therefore, the pushing projection 27 can pass under the abutting projection 28 when the lock arm 17 is free; that is, when the locking projection 18 has engaged with the engagement channel 19. Meanwhile, the pushing projection 27 abuts against the abutting projection 28, when the lock arm 17 has deflected.

Further, the couple of joinder guides 22 formed in the rear part of the joinder member 5 has an engagement channel 29 opened outward, and between the couple of jointing guides 22, there is extended the lock hook 23 cooperative with the second connecting body 3. The couple of joinder guides 22 are joined and fixed to the second connecting body 3. In a forward side of the joinder guides 22, between the couple of the extended arms 21, there is formed a plate-shaped restricting portion 30 with cooperates with the lock arm 17 of the respective connecting bodies 2, 3, 4. The restricting portion 30 is positioned substantially as high as the sliding portion 20.

Figure 3A:
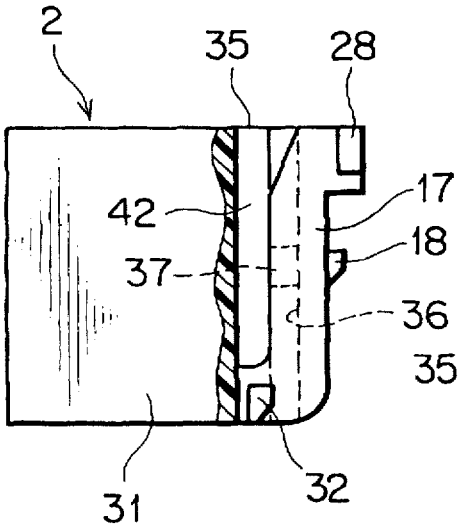
FIGS. 3A and 3B are, respectively, a side view party in section, and the front view of a first connecting body in the embodiment.
Figure 3B:
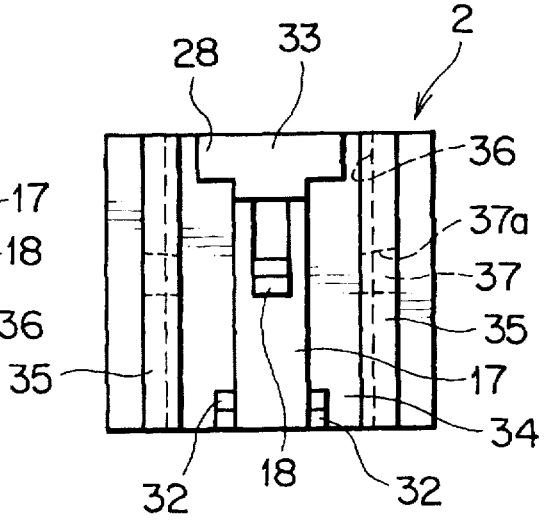

FIGS. 3A and 3B show the first connecting body 2. The lock arm 17 is formed so as to extend from one side of a housing 31 made of a synthetic resin. In each side of a root portion of the lock arm 17, there is formed an abutted projection 32 that cooperates with the abutting projection 24 in the fore end of the joinder member 5. Further, in a rear end of the lock arm 17, the abutting projections 28 which cooperate with the pushing projections 27 of the joinder member 5 are is formed to extend left and right at the same height as an arm operating portion 33. The abutting projections 28 can abut against the pushing projection when the lock arm 17 has been inwardly deflected.

On either side of the lock arm 17, a couple of guiding ribs 35 for the joinder member 5 are formed to extend from a housing wall 34 at the same height as, and in parallel with, the lock arm 17. In each guiding rib 35, a guide channel 36 for the provisional lock hook 26 of the extended arm 21 in the joinder member 5 (FIG. 2) is formed in a longitudinal direction. In an intermediate portion of the guide channel 36, there is formed an engagement hole 37 which cooperates with a provisional lock hook 26. The engagement hole 37 has a rear engagement surface 37*a* tapered to conform with a corresponding surface on the provisional lock hook 26. Each of the sliding portion 20 of the joinder member 5 is slidably received along a housing wall 34 in a lower portion of such guide channel 36.

Besides, in the guiding rib 35, there may be formed a guide channel (not shown) for the sliding portion 20, and, on the guide channel, the guide channel 36 for the provisional lock hook 26 may be formed in the shape of a step. In that case, the interval between the couple of the guide channels 36 is narrower than the interval of the guide channel for the sliding portion 20 so that the provisional lock hook 26 positions inside of the sliding portion 20.

Figures 4A, 4B, 4C:
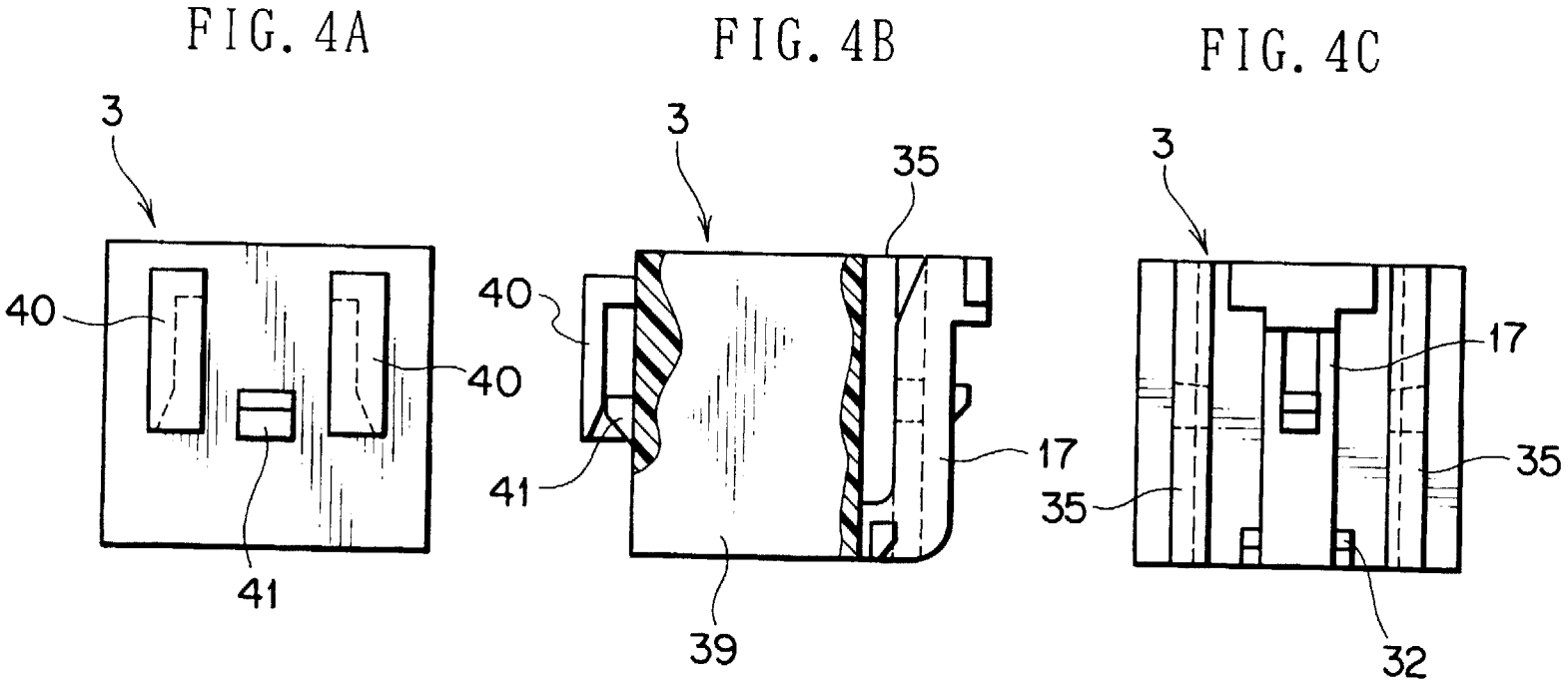
FIGS. 4A, 4B and 4C are, respectively, the rear view, a side view, and the front view partly in section of a second connecting body.
Figure 5:
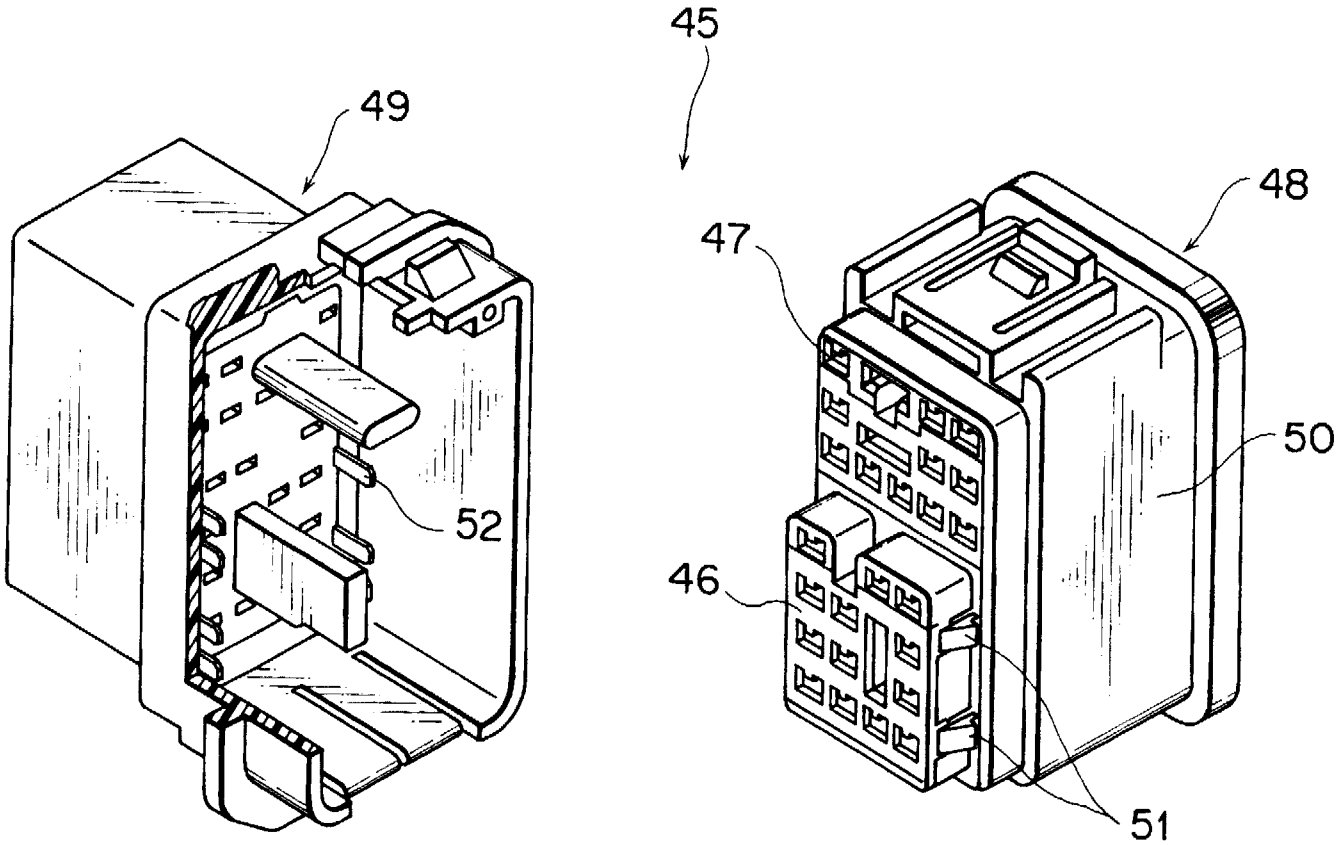
FIG. 5 PRIOR ART
FIG. 5 is a perspective view partly in section showing a conventional reduced insertion force connector assembly.

FIGS. 4A to 4C show the second connecting body 3, in which, in one side wall of housing 39, there are formed a lock arm 17 and a couple of guiding ribs 35 corresponding to those in the first connecting body 2. These are denoted by the same reference numerals as are used in the first connecting body 2 and explanations of them will be omitted.

Further, in the other side wall of the second connecting body 3, there are formed a couple of inwardly directed, reversed-L-shaped joinder guides 40 cooperative with the engagement channels 29 in the joinder guides 22 of the joinder member 5, and an engagement projection 41 provided between the couple of joinder guides 40 for engagement with the lock hook 23.

The third connecting body 4 (FIG. 1), the fourth connecting body (not shown), and so on, are the same in shape as the second connecting body 3. The third connecting body 4 is joined to the second connector 3 by way of the joinder member 5, and, in the same way, the fourth connecting body is joined to the third connecting body 4. The number of the connecting bodies 2, 3, 4 is appropriately determined according to the total number of connecting terminals, the shape/size of the female connector 9, etc. In this embodiment, each of the connecting bodies 2, 3, 4 is joined by a joinder member 5, while, in another embodiment, the joinder member 5 may be formed integrally with the connecting body 3, 4.

By the way, regarding the above-mentioned connecting bodies 2, the abutted projection 32, the constructions of the abutting projection 24 and the tapered projection 25 in the fore end of the joinder member, and the pressing projection 15 in the female connector are similar to those that the assignee of this application has disclosed in Japanese patent application laid-open No. H. 6-215830.

In the following, operation in the low-insertion-force connector i of this invention will be discussed as referring to FIG. 1.

First, each connecting body 2, 3, 4 is joined to an adjacent one by way of the joinder members 5. That is, the joinder guide 22 of each joinder member 5 is slid along and engaged with each joint guide 40 of the second, third connecting bodies 3, 4. Thereby, the lock hook 23 on each joinder member couples with the lock projection 41 on the facing surface of the adjacent connecting body so that each joinder member 5 and each of the connecting bodies 3, 4 are combined in a body.

Next, the joinder member 5 of the second connecting body 3 is coupled to the guiding rib 35 of the first connecting body 2. That is, the provisional lock hooks 26 of the extended arms 21 are inserted into the guiding channels 36 (FIGS. 3A and 3B) to be engaged with the engagement holes 37, and also, the sliding portion 20 is slid along and engaged with the guiding rib 35. Thereby, the joinder member 5 is provisionally locked to the first connecting body 2. Similarly, the joinder member 5 related to the third connecting body 4 is provisionally locked to the guiding ribs 35 of the second connecting body 3. Each of the connecting bodies 2, 3, 4, for example, is inserted slidably into the outer housing 12 in the connector coupling direction.

Each of connecting bodies 2, 3, 4 in the male connector 6 is manually sequentially coupled to the outer housing 12 of the female connector 9. A further advance of the joinder member 5 inserted into the first connecting body 2 releases the engagement between the provisional locking hooks 26 and the engagement holes 37. That is, the tapered fore end surfaces **26*a* of the provisional locking hooks 26 (FIG. 2) makes sliding contact with an opening end of the respective engagement holes 37 (FIGS. 3A and 3B), which deflects inwardly the extended arms 21 so that the provisional locking hooks 26 are released from the engagement holes 37. The tapered rear end surface 26*b* of the provisional locking hooks 26 can abut against a rear end surface 37*a* of the respective engagement holes 37 to prevent retraction of the joinder member 5. The sliding portions 20 make sliding contact with inner surfaces of the guiding ribs 35. The abutting projections 24 in the fore ends of the extended arms 21 abut against the abutting projections 32 of the first connecting body 2 to push the connecting body 2 into an engagement portion 7 of the female connector 9**.

When the first connecting body 2 completely engages with the engagement portion 7, the abutting projection 15 in the female connector 9 simultaneously abuts against the gently sloping projection 25 so as to outwardly deflect the extended arms 21, which releases the engagement between the abutting projections 24 and the abutted projection 32. Thereby, the joinder member 5 advances together with the second connecting body 3, so that the second connecting body 3 begins to engage with the engagement portion 8 in the female connector 9. The engagement operation of the second connecting body 3 with respect to the third connecting body 4 are carried out similarly to that of the first connecting body 2 with respect to the second connecting body 3. In FIG. 1, the distance L between the second connecting body 3 and a bottom wall of the engagement portion 8 is equal to the sum of the distance L1 between the first connecting body 2 and a bottom wall 13 of the engagement portion 7 and an advancing distance L2 of the jointing member 5 released from the abutment.

In FIG. 1, when the first connecting body 2 has incompletely inserted or engaged into the female connector 9, the lock projection 18 on the lock arm 17 of the joinder member 5 does not engage with the abutment of the channel 19 in the associated engagement portion 7 but makes contact with the side wall 16 thereof. Thereby, the lock arm 17 is deflected, so that the abutting projection 28 of the lock arm 17 is pushed by the pushing projection 27 of the joinder member 5. Accordingly, the first connecting body 2 can be completely inserted into the engagement portion 7. Detection of a partially engaged state and pushing operation by the pushing projection 27 are similarly carried out in the other connecting bodies 3, 4. In each of the connecting bodies 2, 3, 4 that has been completely inserted, the deflection-restricting portion 30 (FIG. 2) of the joinder member 5 advances into a deflection permitting space 42 (FIGS. 3A and 3B) for the lock arm 17 to prevent the lock arm 17 from deflecting, that is, to act as a deflection-preventing spacer so that securer locking between the connecting bodies 2, 3, 4 is enabled.

Therefore, according to the present invention, a plurality of connecting bodies can be stepwise coupled to an opposing connector with a reduced insertion force. Thereby, the coupling operation can be accomplished easily by hand without an increased insertion force, even where a great number of connecting terminals are positioned in one connector assembly. Further, even in case of incomplete engagement of the connecting bodies, the pushing projections of the joinder members can detect it for correction of the incomplete engagement. Thus, the incomplete engagement of the connectors can be adequately corrected.

What is claimed is:

1. A low-insertion-force connector assembly comprising:

a first connector having a plurality of adjacent connecting bodies slidable in a direction of connector engagement and a joinder member separate from and disposed between adjacent connecting bodies, each said joiner member, having oppositely spaced end portions and being operative for sequentially joining said adjacent connecting bodies, a second connector receiving the first connector, a guiding portion provided in one of said adjacent connecting bodies, said joinder member being slidable along said guiding portion in a connector-engagement direction, a flexible extended arm provided in one end portion of said joinder member and having an abutting projection and a tapered portion thereon, a joinder portion provided in the other end portion of said joinder member and joining the latter connecting body of said two adjacent ones of said connecting bodies, a provisional locking portion provided on said flexible extended arm and provisionally locking said joinder member to said guiding portion, an abutted projection provided on said former connecting body and abutting against said abutting projection, a mating projection provided in said second connector and slidably mating with said tapered portion to deflect said flexible extended arm so that the engagement between said abutting projection and said abutted projection can be released, a flexible lock arm in said one connecting body and locking said one connecting body to said second connector when said one connecting body is completely engaged with the second connector, said flexible lock arm having a retaining projection, and a pushing projection provided in said extended arm and operative to abut against said retaining projection and deflect said lock arm only when said one connecting body has incompletely engaged with the second connector.

2. A low-insertion-force connector assembly as claimed in claim 1 wherein said joinder member has a deflection restricting portion that can advance into a deflection permitting space on said one connecting body for restricting deflection of said lock arm.

3. A low-insertion-force connector assembly as claimed in claim 1, wherein said provisional locking portion for said joinder member has a provisional locking hook, said guiding portion has an engagement hole engageable with said provisional locking hook, and said provisional locking hook has a tapered surface permitting release of said provisional locking hook from said engagement hole when said flexible extended arm advances from the provisional locking state.

4. A low-insertion-force connector assembly as claimed in claim 1, wherein said joinder portion in said joinder member has a lock hook engaging with a locking projection provided in said adjacent connecting body and said portion engages with a joinder guide formed in said adjacent connecting body.

* * * * *